US005839991A

United States Patent [19]

Hall

[11] Patent Number: 5,839,991

[45] Date of Patent: Nov. 24, 1998

[54] PORTABLE OCCUPATIONAL THERAPY DEVICE

[76] Inventor: Timothy L. Hall, 3204 Sherman Rd., Oconto, Wis. 54143

[21] Appl. No.: 747,261

[22] Filed: Nov. 12, 1996

[51] Int. Cl.[6] ..... A63B 26/00; A63B 21/00; A61H 1/00

[52] U.S. Cl. ..... 482/23; 482/138; 482/910; 601/33

[58] Field of Search ..... 601/23, 24, 33–35, 601/86, 90, 98; 482/135–138, 35, 36, 87, 904, 148, 37, 23; 248/157, 159, 161, 205.2, 415

[56] References Cited

U.S. PATENT DOCUMENTS

| | | | |
|---|---|---|---|
| 786,672 | 4/1905 | Pfund . | |
| 904,815 | 11/1908 | Sletto | 601/23 |
| 2,135,018 | 11/1938 | Svensson | 601/33 |
| 3,006,644 | 10/1961 | Usher et al. . | |
| 3,127,171 | 3/1964 | Noland et al. | 482/137 |
| 3,209,729 | 10/1965 | Zedaker | 248/206.5 X |
| 3,543,699 | 12/1970 | Leikarts | 248/159 |
| 3,612,042 | 10/1971 | Fry | 601/24 |
| 3,849,933 | 11/1974 | Kuntz | 482/148 |
| 4,817,941 | 4/1989 | McCorry | 482/87 X |
| 4,856,775 | 8/1989 | Colledge et al. | 482/148 |
| 4,864,698 | 9/1989 | Brame | 128/DIG. 15 X |
| 4,865,283 | 9/1989 | Parker | 248/159 |
| 4,895,543 | 1/1990 | Vermette | 446/105 |
| 5,040,522 | 8/1991 | Daniels | 601/33 |
| 5,154,391 | 10/1992 | Hegarty | 248/205.2 X |
| 5,265,589 | 11/1993 | Wang | 128/25 |
| 5,297,768 | 3/1994 | Denton | 248/205.2 X |
| 5,352,170 | 10/1994 | Condo et al. | 482/87 X |
| 5,403,190 | 4/1995 | Wickstrom | 434/260 |
| 5,458,552 | 10/1995 | Mara | 482/87 X |
| 5,470,037 | 11/1995 | Willis | 248/415 |
| 5,575,742 | 11/1996 | Wu | 482/142 |

*Primary Examiner*—Richard J. Apley
*Assistant Examiner*—Denise Pothier
*Attorney, Agent, or Firm*—Godfrey & Kahn, S.C.

[57] ABSTRACT

A therapy device for conducting rehabilitative exercises that includes a base having a receptacle. A standard is capable of being positioned in the receptacle in a substantially vertical position and has a plurality of adjustable arms slidably mounted on it. A locking mechanism is used to secure the standard in the vertical position. Each arm has means for being slidably mounted to the standard and a locking mechanism for fixing the arm at a height along the vertical, longitudinal axis of the standard. Each arm also includes a fastening means for removably securing occupational therapy exercise items, such as hooks, rings, and other items. The base of the therapy device include a slot for receiving the standard and may be shaped and sized to resemble an attaché or brief case and to include a handle and one or more bins for holding occupational therapy exercise items. The bin may be compartmentalized and have a lid to secure exercise items therein. A locking mechanism may be mounted on the base so that the standard may be secured within the slot. So secured, the base and standard may be transported by grasping and moving the device by means of the handle. Once at a desired location, the device may be assembled by removing the standard from the slot, placing it in the receptacle, and positioning the arms on the standard. A variety of exercises may be accomplished by using the arms as platforms for the exercise items secured within the bin.

18 Claims, 7 Drawing Sheets

100A
100B
100
110
82
108
107
106
102
80
21
23
22
104
20
84
30
105
27
25
89
19
31
24
16
86
18

PORTABLE OCCUPATIONAL THERAPY DEVICE

BACKGROUND OF THE INVENTION

The present invention relates to exercise and rehabilitation devices. More particularly, the present invention relates to an occupational therapy device that is portable and may be configured so that a variety of exercises may be carried out using it.

The goals of occupational and physical therapy are to direct participation in selected tasks to restore, reinforce, and enhance physical performance; facilitate learning of skills and functions essential for adaptation and productivity; diminish or correct pathology; and to promote and maintain health. Various exercise devices have been developed for use by patients to aid in their rehabilitation. Existing devices include peg boards, cones, writing boards, and other items with which exercises that mimic the body motion of common tasks can be carried out. Typically, these devices are available in large clinics or hospitals in specialized therapy rooms or centers and might be placed on tables or at exercise stations. However, rehabilitation is increasingly carried out at patients' homes in order to reduce costs and also continue therapy after patients have left a medical facility. Thus, therapists often travel to their patients' homes, bringing with them a variety of exercise items. As might be expected, a home environment often lacks the facilities necessary to properly and easily conduct therapy. In addition, transporting enough and proper exercise items to conduct effective therapy can be difficult.

Accordingly, there is a need for an occupational therapy device with which a variety of exercises can be carried out. It would be desirable if the same device could be used in hospitals and clinics, where patients often begin therapy, and be readily transported by therapists to patients' homes to continue therapy. It would also be desirable if the device was constructed so that therapists could design unique exercises to be carried out in order to provide customized therapy for their patients.

OBJECTS AND SUMMARY OF THE INVENTION

Therefore, it is an object of the present invention to provide an improved therapy device.

A further object of the present invention is to provide a therapy device with which a variety of occupational therapy exercises can be carried out.

A further object of the present invention is to provide a therapy device which is readily transportable and may be used in hospitals and other treatment centers as well as patients' homes.

These and other objects and advantages are achieved in a therapy device that includes a base having a receptacle. The device also includes a standard having a first end for being received in the receptacle and a second end. The standard is designed to be positioned in the receptacle in a substantially vertical position and to have a plurality of adjustable arms slidably mounted on it. A locking mechanism is used to secure the standard in its vertical position when it is placed in the receptacle.

Each arm has a first end and a second end. The first end has means for being slidably mounted to the standard and a locking mechanism for fixing the arm at a height along the vertical, longitudinal axis of the standard. Each arm also includes a fastening means for removably securing occupational therapy exercise items, such as hooks, rings, and other items. The fastening means of each arm is positioned longitudinally along the arm and covers at least about 20% of the surface area of the arm.

The base of the therapy device may be shaped and sized to resemble an attaché or brief case and to include a handle and one or more bins for holding occupational therapy exercise items. The bin may be compartmentalized and have a lid to secure exercise items therein. The base is designed with a slot for receiving the standard. A locking mechanism may be mounted on the base so that the standard may be secured within the slot. So secured, the base and standard may be transported by grasping and moving the device by means of the handle. Once at a desired location, the device may be assembled by removing the standard from the slot, placing it in the receptacle, and positioning the arms on the standard. A variety of exercises may be accomplished by using the arms as platforms for the exercise items secured within the bin.

The exercise items may have fastening means, such as magnetic strips or hook and pile fasteners, so that exercises may be accomplished by placing and removing items on and from the arms. The lid of the bin may also include means for removably fastening an exercise item, such as a writing board or peg board, to it and be configured so that exercises may be carried out when the exercise item is placed on the lid.

These and other objects and advantages of the present invention will become more apparent from the following detailed description of the invention taken in combination with the accompanying drawings.

DETAILED DESCRIPTION

Figure 1:
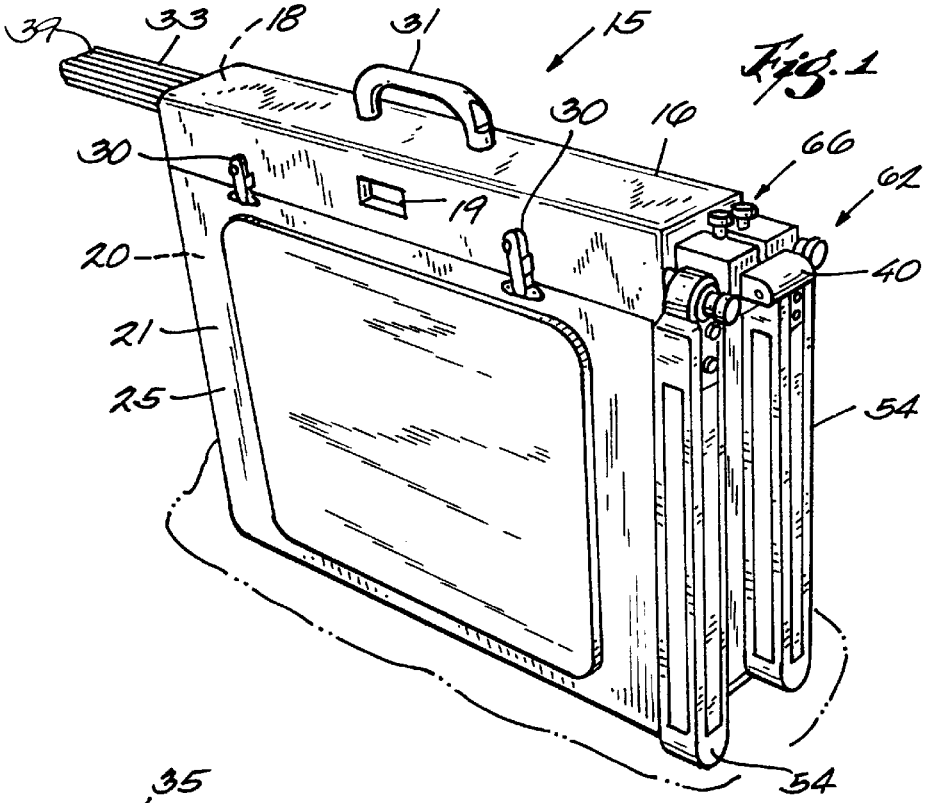
FIG. 1 is a perspective view of the therapy device of the present invention showing the device ready to be transported, having the standard inserted in the slot of the base.
Figure 3:
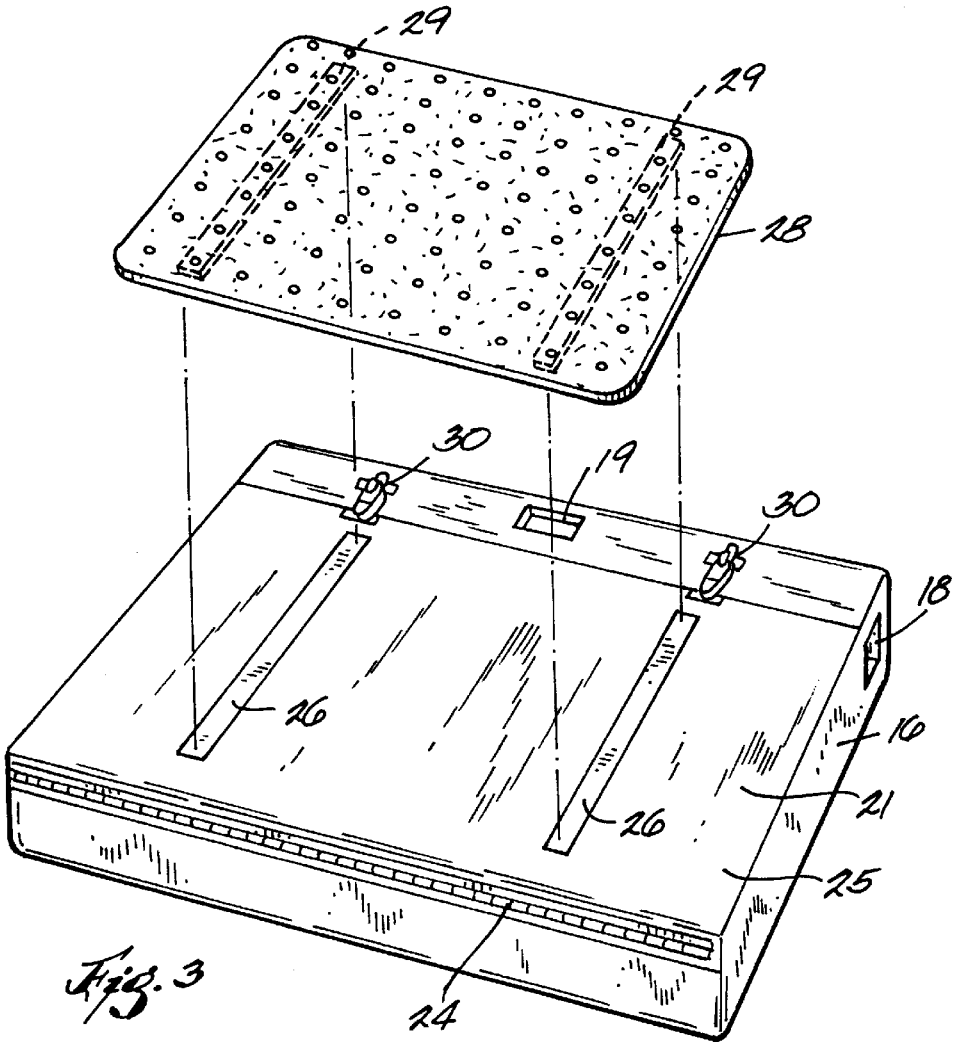
FIG. 3 is a perspective view of the base of the therapy device showing the manner in which an exercise item is attached to the fastening means of the lid.
Figure 10:
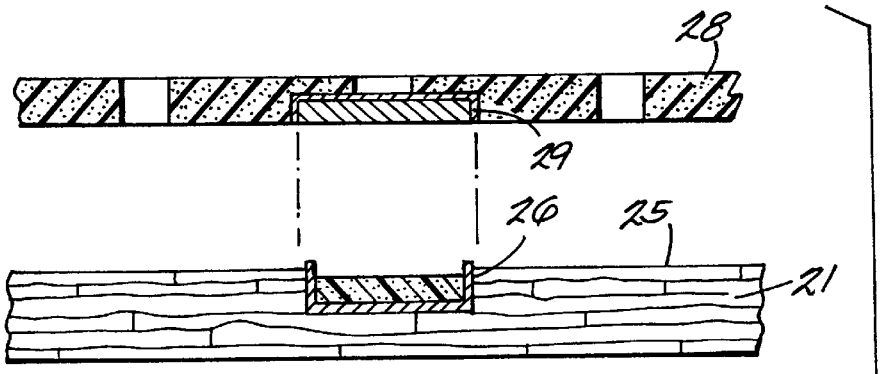
FIG. 10 is a cross-sectional view of the therapy device taken along the line 10—10 of FIG. 3.
Figure 4:
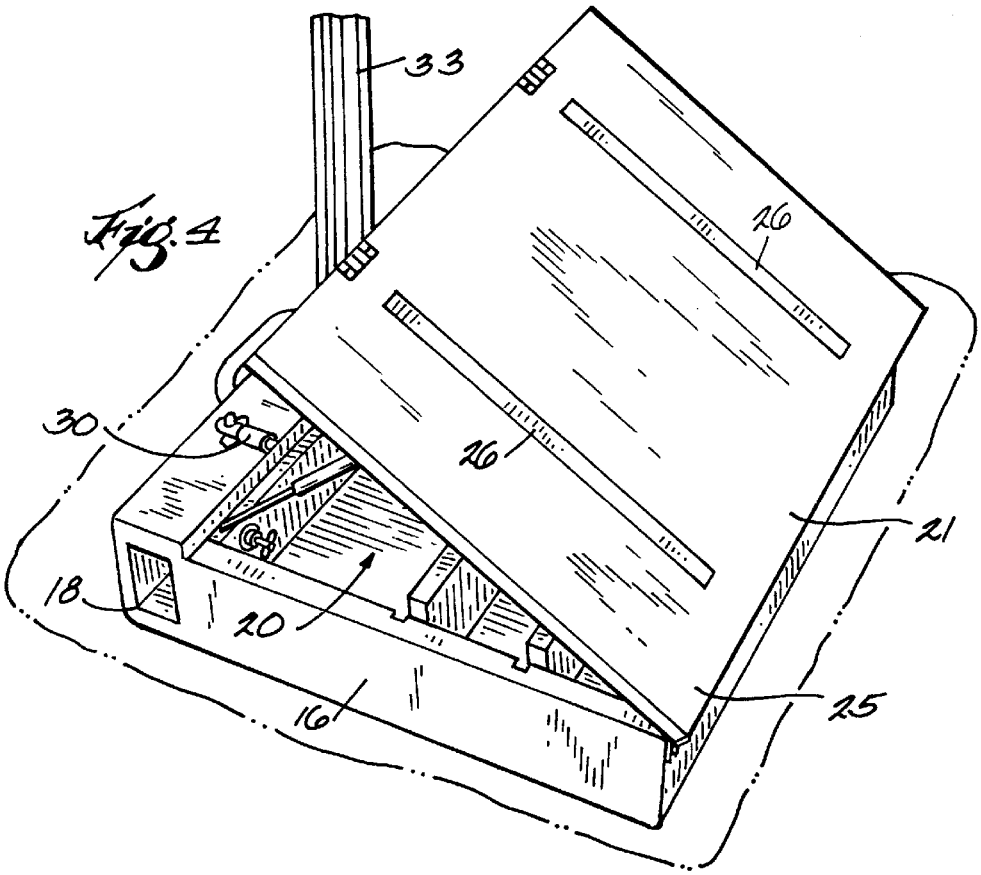
FIG. 4 is a perspective view of the therapy device showing the bin in the base of the device.
Figure 11:
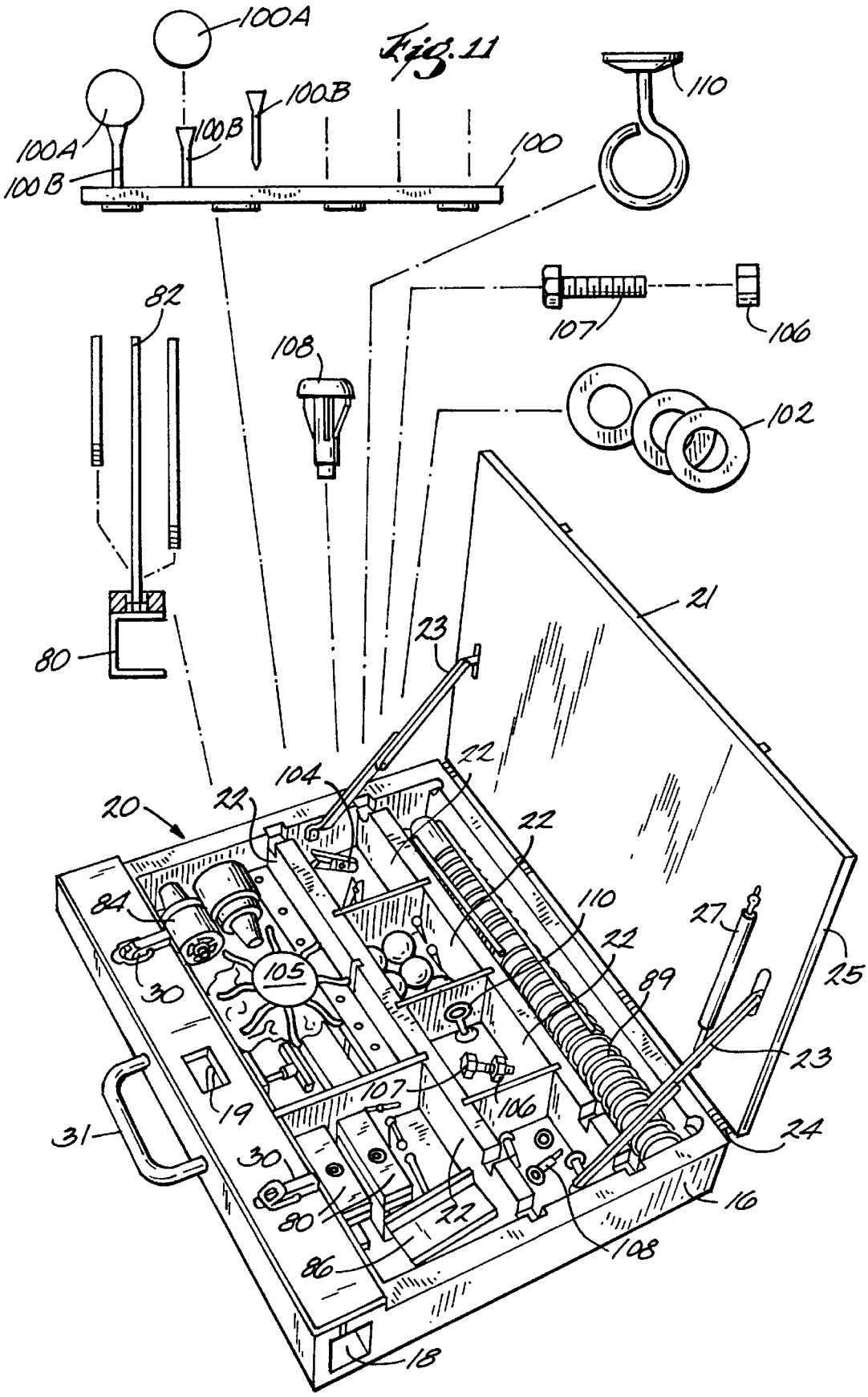
FIG. 11 is a perspective view of the therapy device showing the bin of the base with its lid open and various exercise items in the compartments of the bin.

Referring more particularly to the drawings, a therapy device 15 is shown in FIG. 1. The therapy device 15 includes a base 16 having a slot 18, a receptacle 19, and a bin 20 with a lid 21. As seen in FIG. 11, the bin 20 may have one or more compartments 22 for holding a variety of exercise items which are discussed further herein. One or more first hinges 23 and a second hinge 24 fasten the lid 21 to the base 16. The lid 21 has a top surface 25 with one or more fastening means 26. (FIG. 3). The fastening means 26 may be magnetic strips or hook and pile fasteners. As seen in FIG. 3, one or more exercise items, such as a peg board 28, having one or more fastening means 29, may be mounted on the lid 21. An adjustable cylinder 27 (FIG. 11) may be used to lock the lid 21 in a desired open position. Latches 30 are used to secure the lid 21 closed.

Figure 12:
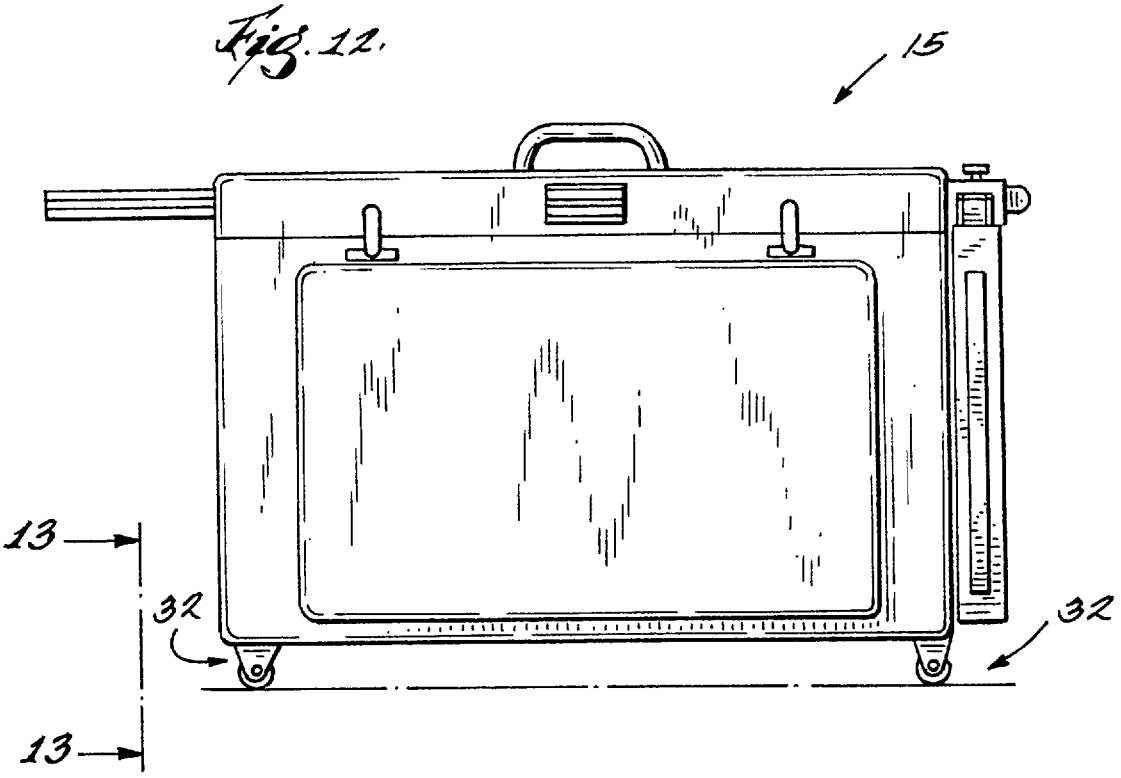
FIG. 12 is a perspective view of the therapy device of the present invention showing an alternative embodiment where wheels are mounted on the base.
Figure 13:
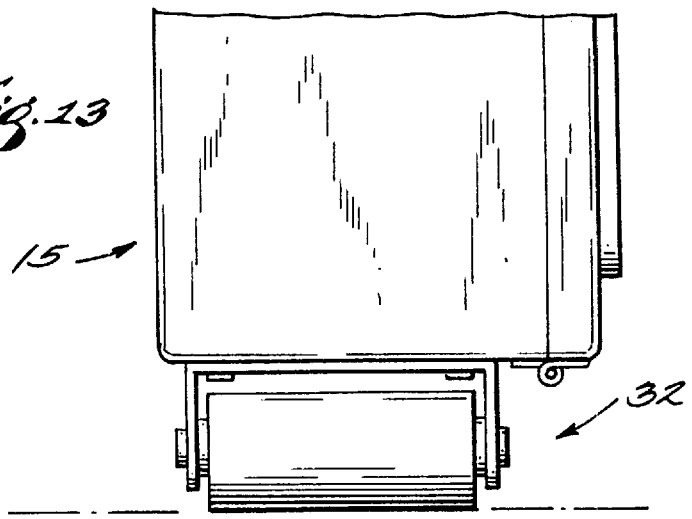
FIG. 13 is a partial end view of the therapy device of the present invention taken along the line 13—13 of FIG. 12.

The base 16 is sized and shaped to resemble a slightly oversized attaché or brief case and a handle 31 is provided on the base so that the therapy device 15 can be more readily transported. However, the base 16 may also be configured as a cart (FIGS. 12 and 13) with wheels 32 on one or more of its sides to facilitate transportation of the therapy device 15.

Figure 5:
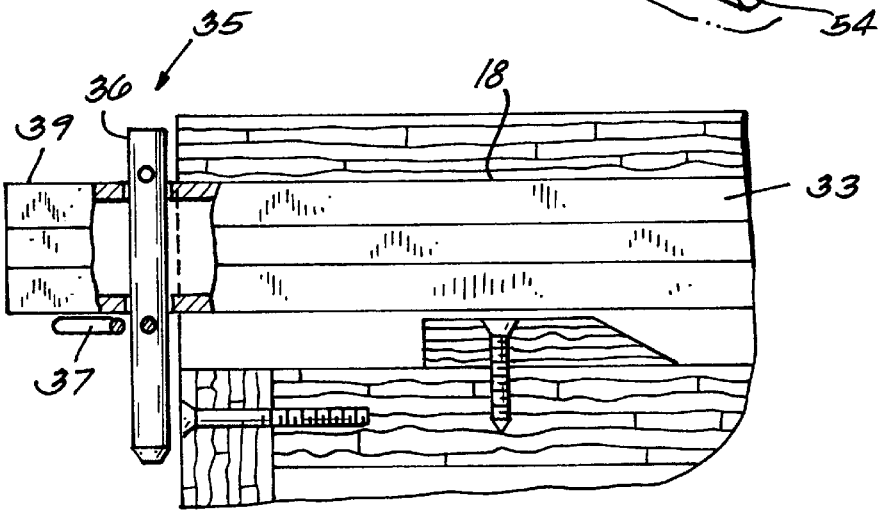
FIG. 5. is partial, cross-sectional view of the therapy device taken along the line 5—5 of FIG. 1.
Figure 9:
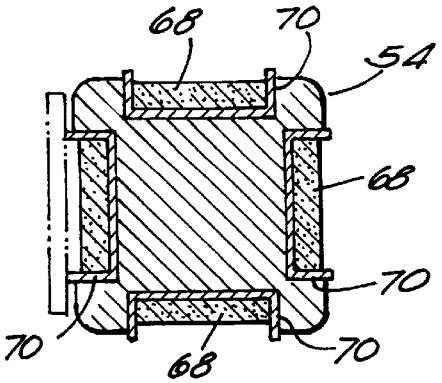
FIG. 9 is a cross-sectional view of the arms of the therapy device taken along the line 9—9 of FIG. 2.
Figure 6:
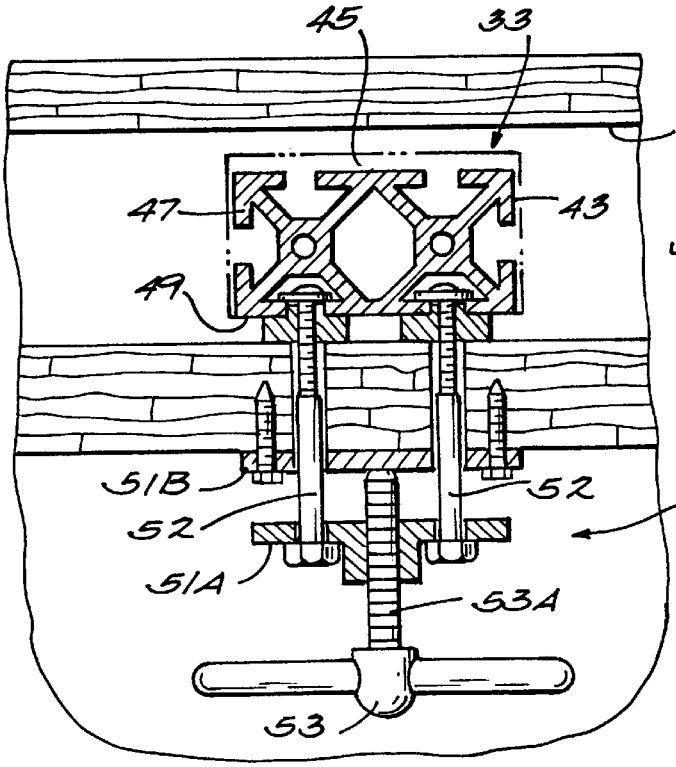
FIG. 6 is a partial, cross-sectional view taken along the line 6—6 of FIG. 4.

As seen in FIG. 5, the slot 18 is designed to hold a standard 33. A locking mechanism 35, such as a pin 36 and cotter pin 37 combination, may be used to secure the standard in the slot 20. When the standard is placed in the slot 18, it and the base 16 form a readily transportable unit. The standard 33 has a first end 39, which is designed to be received in the receptacle 19, and a second end 40 (FIG. 1). The standard 33 is rectangularly shaped and has four grooved sides 43, 45, 47, and 49 (FIG. 6.). The sides 43 and 47 each have one slot and the sides 45 and 49 each have two slots. A suitable standard may be constructed from extruded aluminum tubing such as the tubing sold under the trade designation 10/20 available from 80/20 Inc., Fort Wayne, Ind.

Figure 2:
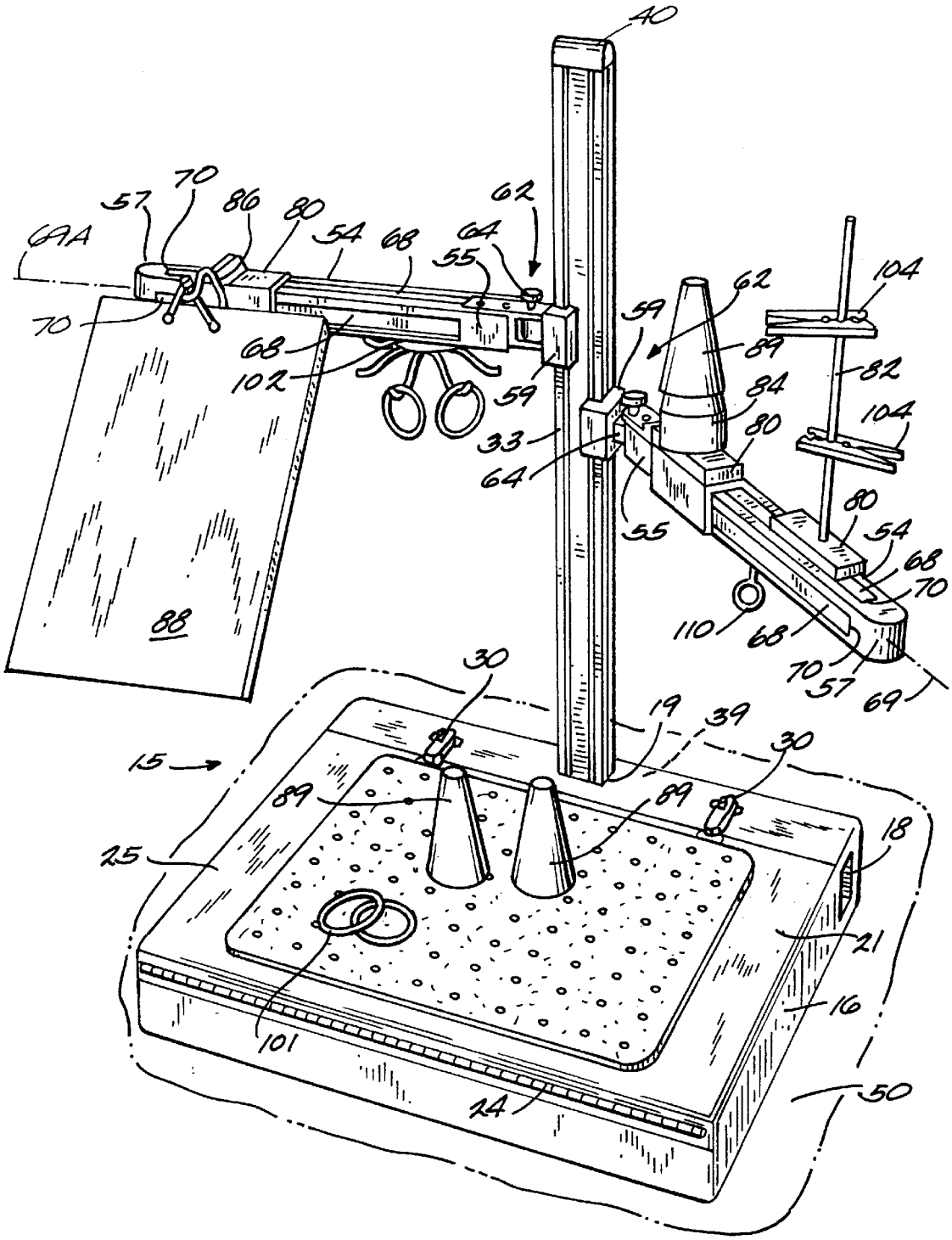
FIG. 2 is a perspective view of the therapy device of the present invention showing the standard inserted in the receptacle of the base, two adjustable arms mounted on the standard, and a variety of therapy exercise items mounted on the arms.

As shown in FIG. 2, when the device 15 is in use, the base 18 is positioned horizontally on a relatively flat surface 50, such as a table top or floor. The first end 39 of the standard 33 is positioned within the receptacle 19 and a locking mechanism 51 (FIG. 6.) secures the standard in place, in a substantially vertical position. The locking mechanism includes plates 51A and 51B, two securing bolts 52, and a handle 53 having a threaded shaft 53A. The bolts are inserted through the plate 51B are adapted at one end to fit within the slots of the side 49 of the standard 33. As the handle 53 is turned clockwise, the threaded shaft 53A is extended to bear against the plate 51B causing the securing bolts 52 to pull the standard 33 into a secured position within the receptacle 19.

Figure 7:
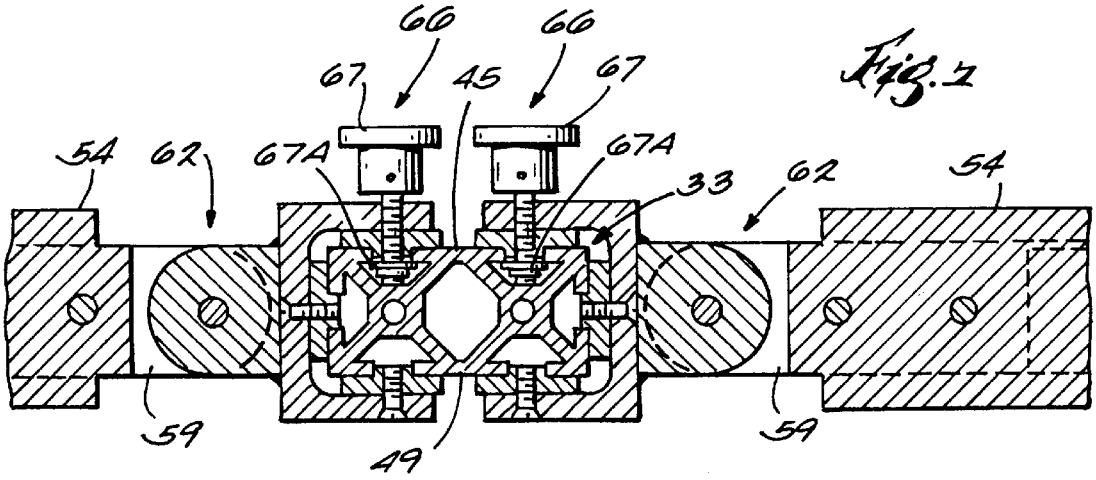
FIG. 7 is a cross-sectional view of the standard and arms of the therapy device.
Figure 8:
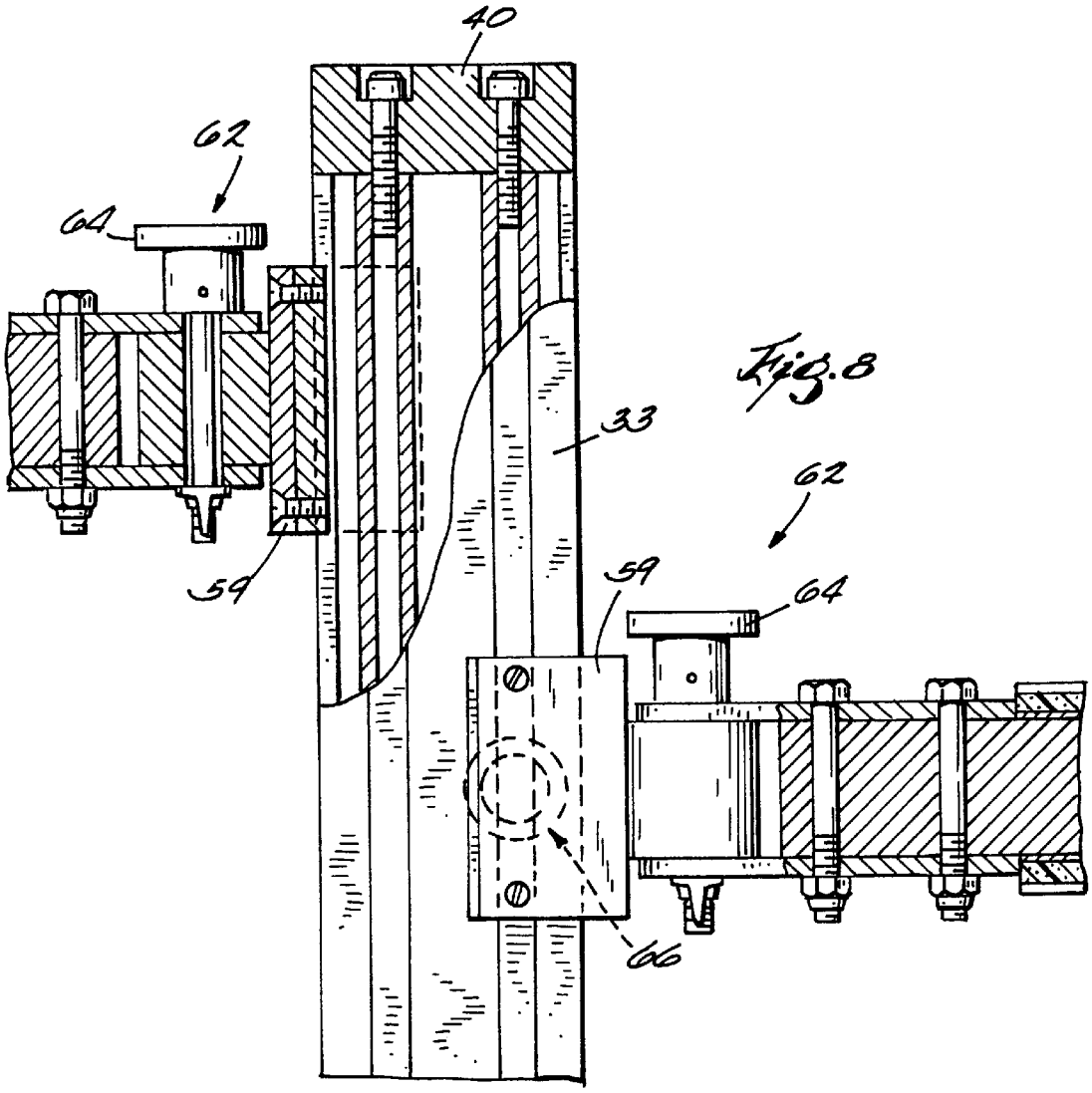
FIG. 8 is a side elevational, partially cutaway view of the standard and arms of the therapy device.

Referring now to FIGS. 2, 7, and 8, a plurality of arms 54, preferably four-sided and rectangularly shaped, are removably and slidably mounted on the standard 33. Each arm 54 has a first end 55 and a second end 57. Mounted on the first end 55 of each arm is a guide 59 for being slidably mounted to the standard 33. Each guide 59 slidably engages one of the grooved sides of the standard 33. Each first end 55 is pivotally or adjustably mounted to the guide 59 by a pivot assembly 62. Each pivot assembly 62 allows each arm to move along a horizontal plane which is substantially parallel to the surface 50. Each pivot assembly 62 includes a threaded screw 64 which may be tightened to secure the arms 54 in desired positions (FIG. 8).

Each guide 59 also includes a locking mechanism 66 (FIG. 7) for securing each arm 54 in a desired vertical position on the standard 33. Each locking mechanism includes a threaded screw 67 having a head 67A which is adapted to fit in one of the slots of the side 45 of the standard 33. The screws 67 can be tightened against the standard 33 securing the arms 54 in place. Through the use of the pivot assemblies 62, guides 59, and locking mechanisms 66 each arm is adjustable in two directions, vertically and horizontally, allowing the arm to be positioned in a variety of placements so that various exercises may be carried out. If desired, the device 15 may be designed so that the arms are adjustable in a third direction, specifically rotation around their longitudinal axes 69 and 69A (FIG. 2). Such a design may be achieved using components and technology known in the art.

Each arm 54 has a plurality of fastening means 68 mounted longitudinally on its sides (FIG. 2). Preferably, at least two fastening means are placed on each arm. Each fastening means may be mounted within a channel 70. Preferably, the fastening means are magnetic strips which cover at least about three-fourths of the length of each arm. The fastening means are designed to hold a variety of exercise items (discussed further below) that may be placed on and removed from the arms 54 by patients carrying out therapeutic exercises. In place of, or on top of, the magnetic strips, hook and pile strips, such as Velcro fasteners, may be used. Though not preferred, it is possible that the arms may be circular or otherwise curved in cross section, in which case the fastening means should cover a sufficient surface area of each arm to permit exercises to be carried out. It has been found that fastening means should cover at least about 20% of the surface area of the arm.

It is possible to construct a useful embodiment of the present invention without mounting fastening means on each arm 54. Several exercises may be carried out using exercise items which slide on and off the arms 54. As best seen in FIG. 2, U-shaped slides 80 may be placed on each arm 54. The slides 80 may include features such as threaded inserts into which a rod 82 or cone holder 84 may be screwed. The slides 80 may also include clamps and other mounting devices, such as a c-clamp 86, in order to hold exercise items such as a writing board (not shown), the peg board 28, or craft project 88.

The present invention may be used to carry out a variety of occupational exercises. In particular, the present invention may be used to carry out stacking exercises where cones 89 are moved from one arm to the other. Many variations in a cone placement exercise can be achieved because each of the arms 54 is adjustable. Such exercises improve gross motor coordination, visual perception, strength and endurance, range of motion of the upper extremities and trunk of an individual, gross grasp and grip strength, and standing balance and tolerance (if the exercises are performed while standing). Because the therapy device 15 may be placed on a table, a counter top, or on the floor, a wide variety of bending and reaching exercises can also be accomplished.

Using the slide 80 having c-clamp 86, the pegboard 28 can be mounted on the therapy device 15 and exercises performed. Such exercises include creating a pattern of pegs on the pegboard, which improves fine motor coordination. In addition, the C-clamp 86 can also be used to hold craft projects while they are being constructed or painted, thus creating an opportunity for range of motion and strength improvement while performing a purposeful activity. A purposeful activity, in contrast to a purely exercise based activity, is any activity where an objective beyond mere repetition of motion is achieved.

As can be seen by reference to FIG. 11, a golf tee board 100 may be placed on one of the arms 54 and used to promote gross motor coordination as well as visual perception by having a patient place balls 100A on the golf tees 100B at various positions. Fine motor coordination may be enhanced through exercises requiring the placement of small marbles or ball bearings on the golf tees 100B and gross motor coordination can be improved by having patients attempt to knock balls 100A off the golf tees 100B with other balls.

As noted above, Velcro strips can be used as the fastening means 68 mounted on each of the arms 54. A wide variety of fine motor tasks can be accomplished by placing objects on and removing objects from the Velcro strips. In addition, the therapy device 15 can be placed next to a patient who is in a supine position on a treatment mat (not shown) with one or more of the arms 54 extended over the patient. In this position, the therapist is free to assist the patient's movements as he or she reaches up to remove objects from the arms 54. Placing a patient in a supine position may facilitate stabilization of the scapula in a normative position allowing for more successful use of the upper extremity for reaching.

As should be apparent by a review of FIG. 11, various other exercises can be achieved with the therapy device 15. For example, the rod 82 can be placed vertically or horizontally on one of the arms 54 using the one of the slides 80 so that patients may place various sized rings 101, washers 102, clothes pins 104, or other items on them. In addition, items such as a rotary hook 105 may be used to carry out exercises which require placement of the rings 101 or washers 102 on it. This exercise improves fine and gross motor coordination and upper extremity strength. Further, feeding can be simulated and practiced with the use of spoons to scoop items from a bowl (not shown) and raise those items from the bowl to one of the arms 54 which is positioned at mouth level. Various other exercises can be achieved using the therapy device 15 with such items as a dry erase board (not shown), nuts 106 and bolts 107, pegs 108, and pull hook 110.

While the present invention has been described in what is believed to be the most preferred forms, it is to be understood that the invention is not confined to the particular construction and arrangement of the components herein illustrated and described, but embraces such modified forms thereof as coming within the scope of the appended claims.

What is claimed is:

1. A therapy device comprising:

a base having a receptacle;

a standard having first and second ends, the first end for being received in the receptacle;

a plurality of adjustable arms, each arm adjustable in at least two directions and having first and second ends, the first end having means for being slidably mounted to the standard and a locking mechanism, each of the arms also having a fastening means for removably securing occupational therapy exercise items, the fastening means positioned longitudinally along the arm and covering at least 20% of the surface area the arm;

wherein the base, standards, and plurality of arms are connectable to form a device with which occupational therapy exercises can be performed.

2. A therapy device as claimed in claim 1, wherein the base includes a locking mechanism for securing the standard in the receptacle.

3. A therapy device as claimed in claim 1, wherein the base includes a bin for holding occupational therapy exercise items and the bin has a lid.

4. A therapy device as claimed in claim 3, wherein the lid includes means for removably fastening an exercise item to the lid.

5. A therapy device as claimed in claim 4, wherein the base further includes a handle and a slot for receiving the standard.

6. A therapy device as claimed in claim 1, wherein the fastening means is a magnetic strip.

7. A therapy device as claimed in claim 1, wherein the fastening means is a hook and pile fastener.

8. A therapy device comprising:

a standard having first and second ends;

a base having a receptacle for receiving the first end of the standard;

a plurality of adjustable arms, each arm having first and second ends, the first end having means for being slidably mounted to the standard and a locking mechanism; and a fastening means for removably securing occupational therapy exercise items, positioned longitudinally along the arm, and covering at least 20% of the surface area of the arm;

wherein the base, standard, and plurality of arms are connectable to form a device with which occupational therapy exercises can be performed.

9. A therapy device as claimed in claim 8, wherein each arm is adjustable in at least two directions and the base includes a locking mechanism for securing the standard in the receptacle.

10. A therapy device as claimed in claim 8, wherein the base includes a bin for holding occupational therapy exercise items and the bin has a lid.

11. A therapy device as claimed in claim 10, wherein the lid includes means for removably fastening an exercise item to the lid.

12. A therapy device as claimed in claim 10, wherein the base further includes a handle and a slot for receiving the standard.

13. A therapy device as claimed in claim 8, wherein the fastening means is a magnetic strip.

14. A therapy device as claimed in claim 8, wherein the fastening means is a hook and pile fastener.

15. A therapy device as claimed in claim 8, wherein the receptacle positions the standard in a substantially upright position.

16. A therapy device as claimed in claim 8, wherein the base has one or more wheels.

17. A therapy devices as claimed in claim 8, wherein the base is sized and shaped to resemble a briefcase.

18. A therapy device comprising:

a base;

a standard supported by the base; and at least one adjustable arm the at least one adjustable arm adjustable in at least two directions and having first and second ends, the first end having means for being slidably mounted to the standard, and fastening means for removably securing occupational therapy exercise items, the fastening means positioned longitudinally along the at least one arm and covering at least 20% of the surface area of the at least one arm;

wherein the base, standard, and adjustable arm are connectable to form a device with which occupational therapy exercises can be performed.

* * * * *